US006155344A

United States Patent [19]

Myers, Jr. et al.

[11] Patent Number: 6,155,344

[45] **Date of Patent: *Dec. 5, 2000**

[54] DOWNHOLE TOOL CONNECTION FOR LIVE WELL DEPLOYMENT

[75] Inventors: William Desmond Myers, Jr.; Robert R. Green, both of Houston, Tex.

[73] Assignee: Baker Hughes Incorporated, Houston, Tex.

[ * ] Notice: This patent is subject to a terminal disclaimer.

[21] Appl. No.: 09/149,420

[22] Filed: Sep. 8, 1998

Related U.S. Application Data

[63] Continuation-in-part of application No. 08/633,916, Apr. 17, 1996, Pat. No. 5,803,175.

[51] Int. Cl.[7] ..... F21B 17/046

[52] U.S. Cl. ..... 166/55.1; 70/242.6

[58] Field of Search ..... 166/55.1, 70, 297, 166/378, 379, 380, 381, 242.6, 242.7, 240; 175/4.6, 4.52

[56] References Cited

U.S. PATENT DOCUMENTS

| | | | |
|---|---|---|---|
| Re. 25,471 | 11/1963 | Fredd . | |
| 2,231,878 | 2/1941 | Boynton . | |
| 2,280,786 | 4/1942 | Boynton . | |
| 4,116,272 | 9/1978 | Barrington . | |
| 4,253,525 | 3/1981 | Young . | |
| 4,273,186 | 6/1981 | Pearce et al. . | |
| 4,311,197 | 1/1982 | Hushbeck . | |
| 4,368,871 | 1/1983 | Young . | |
| 4,378,850 | 4/1983 | Barrington . | |
| 4,391,326 | 7/1983 | Greenlee | 166/240 |
| 4,415,036 | 11/1983 | Carmody et al. . | |
| 4,427,071 | 1/1984 | Carmody . | |
| 4,444,268 | 4/1984 | Barrington . | |
| 4,448,254 | 5/1984 | Barrington . | |
| 4,476,933 | 10/1984 | Brooks . | |
| 4,522,370 | 6/1985 | Noack et al. . | |
| 4,525,001 | 6/1985 | Lumsden et al. . | |
| 4,531,587 | 7/1985 | Fineberg . | |
| 4,579,174 | 4/1986 | Barrington . | |
| 4,595,060 | 6/1986 | Beck . | |

(List continued on next page.)

FOREIGN PATENT DOCUMENTS

| | | |
|---|---|---|
| 2286840 | 8/1995 | United Kingdom . |
| WO 97/27382 | 7/1997 | WIPO . |

OTHER PUBLICATIONS

Tim Walker, et al., *Downhole Swab Valve Aids in Underbalanced Completion of North Sea Well*, SPE 30421, Society of Petroleum Engineers, Inc., 1995, 3 pages.

Tim Walker, et al., *Underbalanced Completions Improve Well Safety and Productivity*, World Oil, Nov. 1995, 4 pages.

Alexander Sas–Jawprsky II, et al., "Coiled tubing 1995 update: Production applications," *World Oil*, Jun. 1995, 97–105.

*Primary Examiner*—William Neuder

*Attorney, Agent, or Firm*—Duane, Morris & Heckscher LLP

[57] ABSTRACT

A connector is presented for tubing conveyed perforating guns which facilitates connection or disconnection between guns without the need for rotation. A latching mechanism is disclosed which latches by setting down weight and unlatches by an actuating ram camming the latch out of a window. The connectors are configured so that they are sealed internally and have an external profile for interengagement with a seal ram for support and sealing around the outer periphery.

Accordingly, a live well can be isolated using a seal ram around a fired gun because the internal passages through the gun are sealed off by virtue of seals around a hammer piston. The connectors are configured so that an upper gun creates the pressure required to set off the gun below. The connectors are also configured such that when a lower gun is supported by a seal ram, an emergency shear zone is presented opposite a shear ram to ensure that if an emergency well shutdown is required that the shear ram does not have to cut through a section of the gun which contains explosives.

21 Claims, 7 Drawing Sheets

U.S. PATENT DOCUMENTS

| | | | |
|---|---|---|---|
| 4,603,742 | 8/1986 | Wong et al. . | |
| 4,618,000 | 10/1986 | Burris, II . | |
| 4,619,325 | 10/1986 | Zunkel . | |
| 4,624,317 | 11/1986 | Barrington . | |
| 4,655,288 | 4/1987 | Burris, II et al. . | |
| 4,665,991 | 5/1987 | Manke . | |
| 4,711,305 | 12/1987 | Ringgenberg . | |
| 4,750,560 | 6/1988 | Gazda | 166/240 |
| 4,768,588 | 9/1988 | Kupsa | 166/240 |
| 4,825,902 | 5/1989 | Helms . | |
| 4,846,281 | 7/1989 | Clary et al. . | |
| 4,856,558 | 8/1989 | Kardos . | |
| 4,903,775 | 2/1990 | Manke . | |
| 4,907,663 | 3/1990 | Maier . | |
| 4,953,640 | 9/1990 | Kurt . | |
| 4,986,358 | 1/1991 | Lueders et al. . | |
| 5,074,361 | 12/1991 | Brisco et al. | 166/240 |
| 5,159,949 | 11/1992 | Prescott et al. . | |
| 5,201,371 | 4/1993 | Allen . | |
| 5,203,410 | 4/1993 | Cobb et al. . | |
| 5,213,125 | 5/1993 | Leu . | |
| 5,320,176 | 6/1994 | Naquin et al. . | |
| 5,366,014 | 11/1994 | George . | |
| 5,411,096 | 5/1995 | Akkerman . | |
| 5,465,786 | 11/1995 | Akkerman . | |
| 5,506,224 | 4/1996 | Field . | |
| 5,509,481 | 4/1996 | Huber et al. . | |
| 5,529,127 | 6/1996 | Burleson et al. . | |
| 5,603,379 | 2/1997 | Henke et al. . | |
| 5,701,957 | 12/1997 | Williamson et al. . | |
| 5,803,175 | 9/1998 | Myers, Jr. et al. | 166/297 |
| 5,957,209 | 9/1999 | Burleson et al. | 166/242.6 |

DOWNHOLE TOOL CONNECTION FOR LIVE WELL DEPLOYMENT

This application is a c-i-p of Ser. No. 08/633,916 filed Apr. 17, 1996, U.S. Pat. No. 5,803,175.

FIELD OF THE INVENTION

The field of this invention relates to techniques for insertion and removal of perforating guns, particularly tubing-conveyed perforating guns.

BACKGROUND OF THE INVENTION

Perforating guns have traditionally been used to stimulate production from a formation once the well has been drilled. Perforating guns have also been used in existing wells previously on production from a particular zone to initiate production from other zones within the wellbore.

If the well is pressurized, one technique that has been used to facilitate perforation at a given depth is to kill the well with heavy fluids prior to the perforating procedure. However, the technique of killing the well is thought to be undesirable in that it may adversely affect the future performance of the well from the zone to be perforated. The alternative to killing the well is to run the perforating guns into the wellbore in a live condition. To do this requires an assembly of rams and blowout preventers, used in conjunction with an elongated housing that facilitates insertion and removal of downhole tools in the wellbore as well as the tubing, commonly known as a lubricator.

Sometimes the string of guns can be quite lengthy, well in excess of the general length of a lubricator, which is approximately 60 feet. The guns themselves are generally in the order of about 15 feet long and are stacked above the other and spaced accordingly so that when they are spotted below, the perforation will occur at the proper locations and intervals. One of the concerns that has arisen in the past with stacking perforating guns and inserting them through a lubricator is the connections that have been available. In the past, some sort of rotation has generally been required to connect one gun to the other when putting them in a string of guns. This has created complexities required of the lubricator, as well as various hydraulic supplies which have been required to be connected to the lubricator to initiate the required rotation to connect one gun to the other while in the lubricator. Accordingly, one of the objectives of the present invention is to present a connection technique which requires no rotation and can be easily accomplished by merely setting down weight With this objective accomplished, the lubricator employed can be far simpler and it can be set up quicker; but most importantly, the integrity of the joints is far greater when the uncertainties of combined movements are removed for connection of one gun to another.

Another problem that can arise in trying to remove guns after firing from a live well is the potential for leak paths through the fired guns internally thereof. Thus, another object of the invention is to provide connectors which will allow for reliable external sealing around the fired guns for the removal process, while, at the same time, sealing off any internal leak paths, thus allowing for effective well control during the removal operation. The configuration of the connectors is also such that when properly supported by a hanging and seal ram (hereinafter "seal ram"), a section of the connector is presented opposite a shear ram where that section has no explosives. Accordingly, another object of the invention is to present a zone of the connector opposite the shear ram so that if an emergency situation develops, the shear ram does not need to cut through a zone having explosives which could create an extremely dangerous situation at the surface. Yet another objective of the present invention is to provide for easy connection and disconnection between perforating guns. Those and other objectives of the invention will become more apparent after review of the detailed description of the preferred embodiment below.

SUMMARY OF THE INVENTION

A connector is presented for tubing-conveyed perforating guns which facilitates connection or disconnection between guns without the need for rotation. A latching mechanism is disclosed which latches by setting down weight and unlatches by an actuating ram camming the latch out of a window. A lug-in-groove combination acts to absorb longitudinal forces to reduce such loads on latching dogs. The connectors are configured so that they are sealed internally and have an external profile for interengagement with a seal ram for support and sealing around the outer periphery.

Accordingly, a live well can be isolated using a seal ram around a fired gun because the internal passages through the gun are sealed off by virtue of seals around a hammer piston. The connectors are configured so that an upper gun creates the pressure required to set off the gun below. The connectors are also configured such that when a lower gun is supported by a seal ram, an emergency shear zone is presented opposite a shear ram to ensure that if an emergency well shutdown is required, the shear ram does not have to cut through a section of the gun which contains explosives.

BRIEF DESCRIPTION OF THE DRAWINGS

FIG. 1 is an assembly view in section of a lower gun and an upper gun with the connector in between.

DETAILED DESCRIPTION OF THE PREFERRED EMBODIMENT

Figure 1:
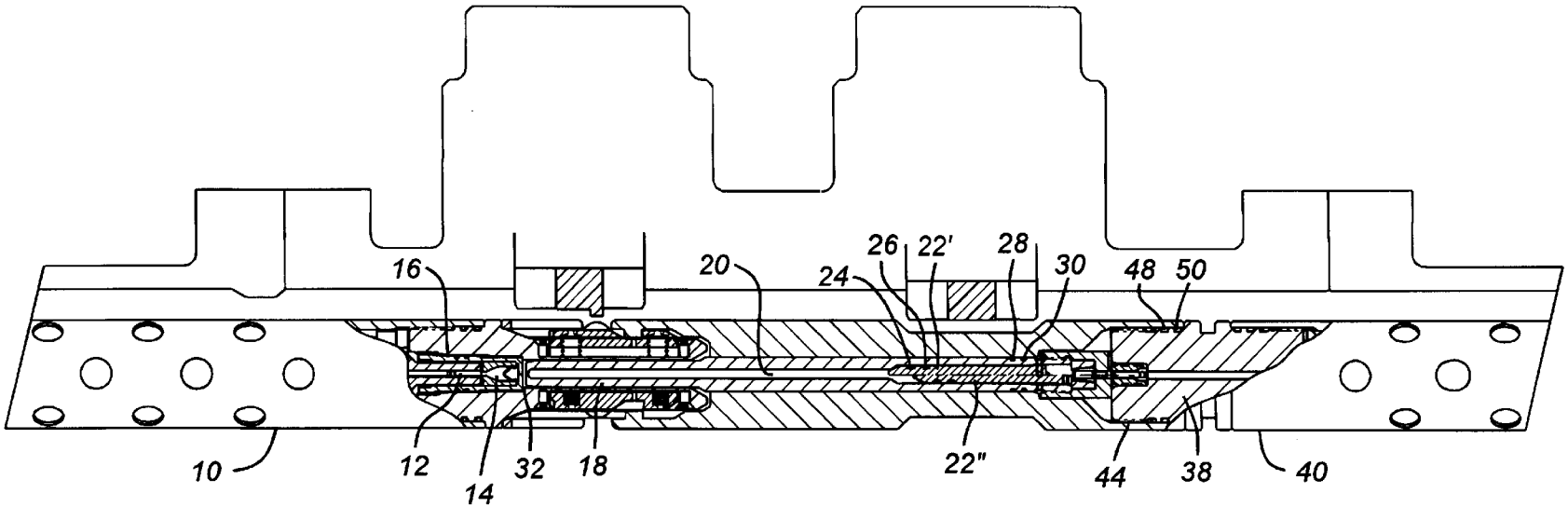

The invention is best understood by looking at the overall assembly in FIG. 4 which illustrates a series of components inside a lubricator L, which is represented schematically. FIG. 4 also shows the overall layout of the lubricator L. FIGS. 1 and 3 show an upper gun assembly 10 which includes a booster 12 and a shaped charge 14. The shaped charge is in a housing 16 which is abutting housing 18. Within hammer piston housing 18 is a passage 20 which communicates to hammer piston 22. Hammer piston 22 is shown in split view. In the position 22', the hammer piston 22 is in the pre-firing position, and in the position indicated by 22", it is in the fired position. The hammer piston 22 has seals 24 and 26 at its upper end, and seals 28 and 30 at the lower end of housing 18. Seals 24–30 seal around the hammer piston 22 and its housing 18 in passage 32, which extends through emergency shear zone 34 (see FIG. 4). Seals 31 and 33 are mounted to housing 16 to seal between housing 16 and passage 32. The details are more readily observable in FIG. 2. Below hammer piston 22 is percussion initiator 36. Below the percussion initiator 36 is the connector sub 38 of lower gun 40. Those skilled in the art will appreciate that movement of hammer piston 22 initiates the percussion initiator 36 which, in turn, fires gun 40 through connector sub 38. The connector sub 38 is secured at thread 44 to body 46 of the connector C. Seals 48 and 50 seal the connection formed by thread 44.

Figure 2:
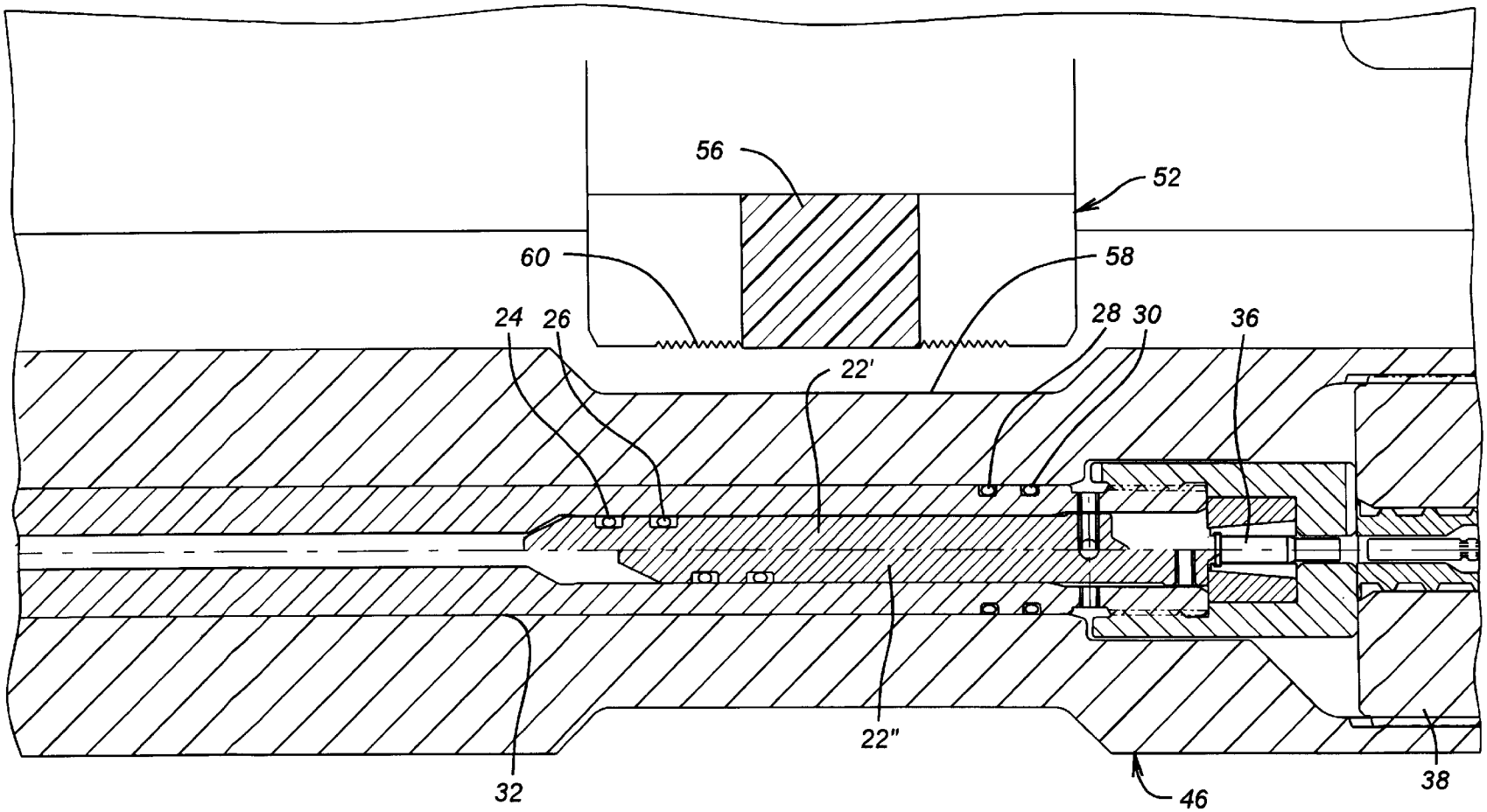
FIG. 2 is a detail of the connector shown in FIG. 1, illustrating the hammer piston in split view with the seal ram supporting the lower gun.
Figure 3:
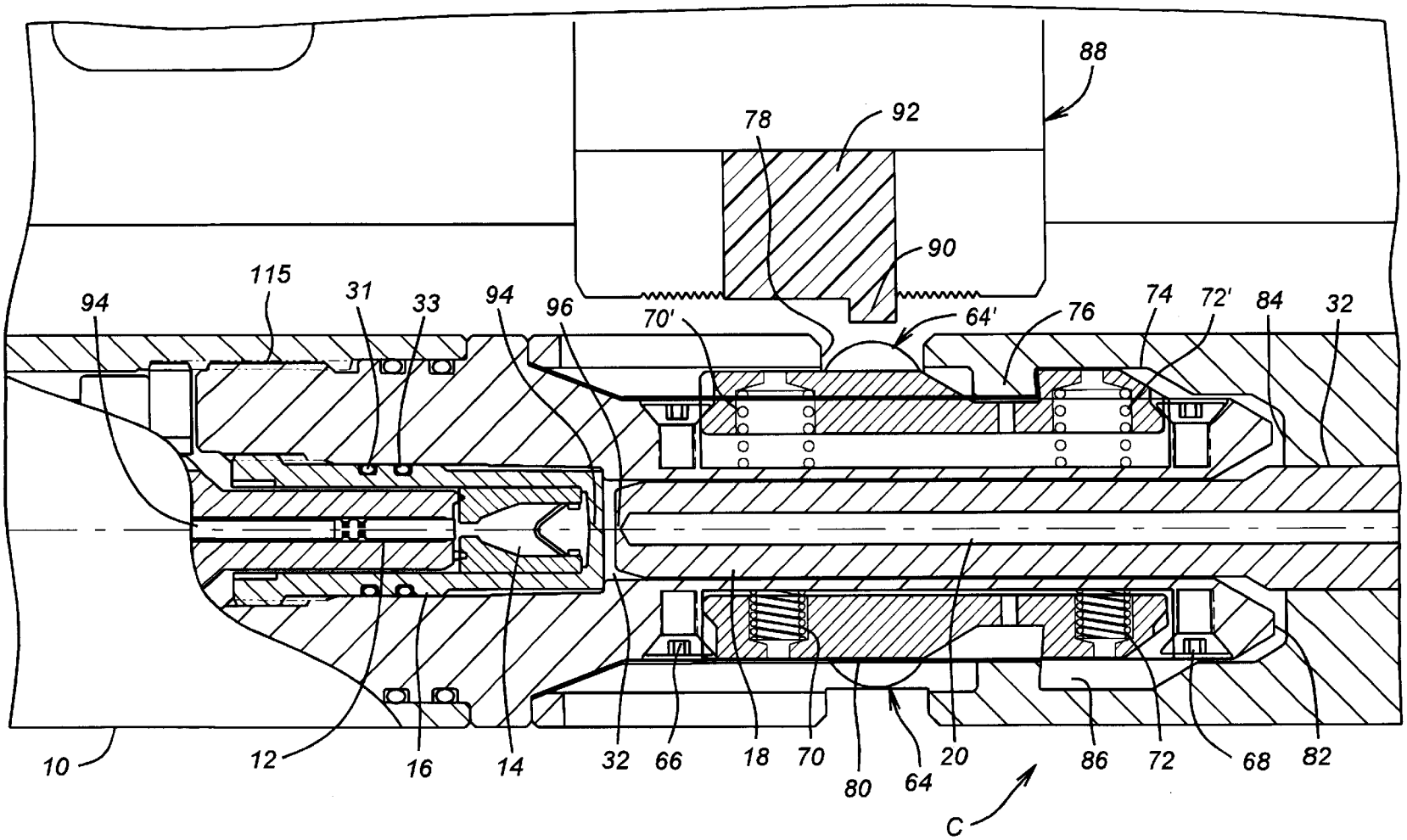
FIG. 3 is a detail of the assembly shown in FIG. 1, illustrating in more detail the latch assembly in the latched position.
Figure 4A:
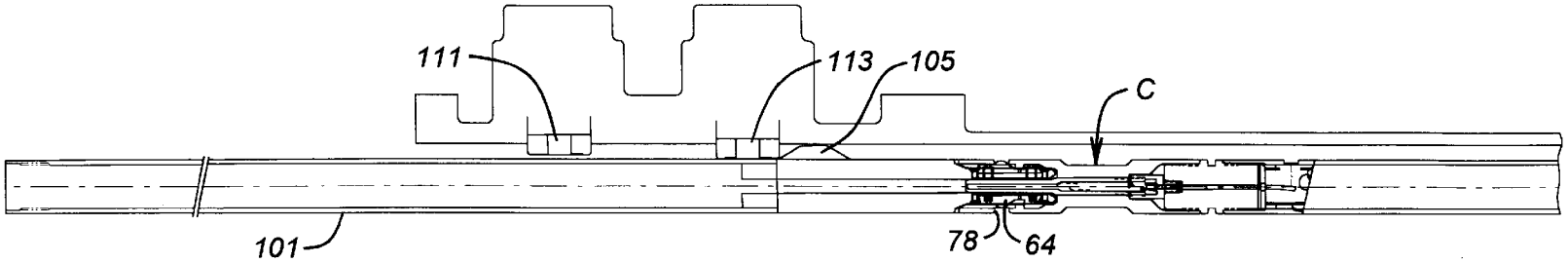
FIGS. 4*a*–4*c* are a layout of an assembly of guns in a lubricator, showing the configuration of the rams and the guns within the lubricator in section view.
Figure 4B:
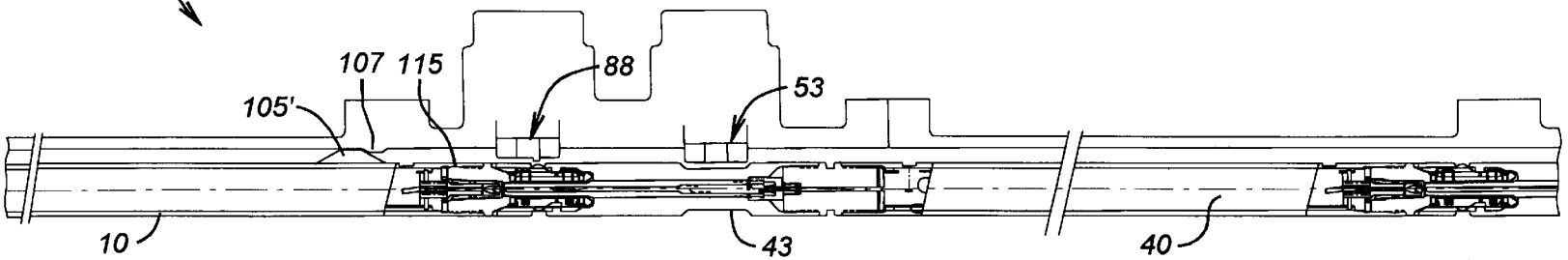
Figure 4C:
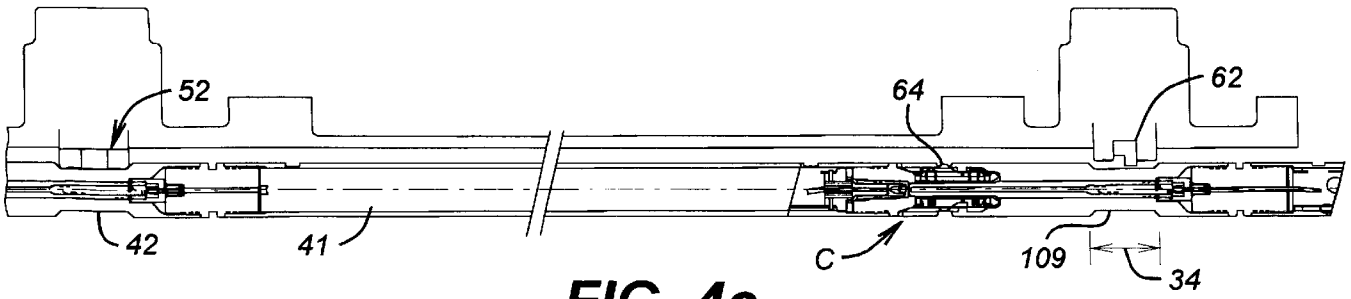

The lubricator L has several seal rams 52 and 53 designed to engage the recesses 42 and 43 when the seal rams 52 and 53 are engaged, as shown in FIGS. 2 and 4. The seal ram, such as 52, has a sealing element 56 which engages all around surface 58, effectively sealing around the exterior of the lower gun 40. The seal ram 52 has a serrated gripping surface 60 to better secure the position of the lower gun 40. Illustrated schematically in FIG. 4 is shear ram 62 which is supported by the lubricator L and is in alignment with emergency shear zone (arrow 34) formed by recess 42 on the body 46. Accordingly, when the lower gun 40 is engaged, as shown in FIG. 2, by the seal ram 52, the shear ram 62 is in position to cut through body 46 in the approximate location of hammer piston 22 of another gun 41 below gun 40 (see FIGS. 4*b*–4*c*). It should be noted that there are no explosives in the emergency shear zone defined by arrow 34. Accordingly, if an emergency shutdown of the well is required, the shear ram 62 can be actuated without concerns that it will aggravate the problem by having to penetrate an explosive charge.

The details of the latching of one gun to another through the connector C is best seen in FIG. 3. The upper gun assembly 10 has a series of dogs 64 which are retained, respectively, at the upper and lower ends by retainers 66 and 68. The dogs are spring-biased outwardly by springs 70 and 72. It should be noted that FIG. 3 is again a split view, with the lower portion indicating the dogs 64 in the retracted position with springs 70 and 72 compressed. On the top portion of the drawings, the dogs 64' are in an expanded position with springs 70' and 72' in a more relaxed or expanded position. The connector C, which has a body 46, has an internal groove 74 adjacent an inwardly oriented projection 76 and followed by a window 78. Dogs 64 have a projection 80 which, when aligned with window 78, can facilitate the outward movement of the dogs 64 into the latching position shown in FIG. 3. Those skilled in the art will appreciate that with the lower gun 40, which is shown in FIG. 4, firmly supported by ram 52 that setting down weight on the upper gun assembly 10 advances the nose 82 into the receptacle 84 of body 46 on connector C. Initially, the dogs 64 are pushed radially inwardly to allow projection 86 on dogs 64 to pass beyond projection 76 on connector C. Once the dogs 64 have been cammed inwardly by projection 76, they can then spring out behind projection 76 into internal groove 74. Thus, when projection 86 on dogs 64 extends into groove 74, it is held there by the springs 70' and 72', while, at the same time, the projection 80 is in window 78. This latching procedure is accomplished exclusively with setting down weight on the upper gun assembly 10. When it is time to disengage, the procedure is reversed with the assistance of actuating ram 88. Actuating ram 88 has a projection 90 on a release element 92. When it is time to disengage, the actuating ram 88 is advanced toward projection 80 until it contacts projection 80 and squeezes springs 70' and 72' to get them in the position shown for springs 70 and 72 at the lower portion of FIG. 3. With the dogs 64, as shown in the lower portion of FIG. 3, and projection 80 out of window 78, an upward pull on upper gun assembly 10 results in a release at the connector C. Again, release is accomplished with a combined actuation of the actuating ram 88 coupled with an upward pull on the upper gun assembly 10.

Figure 5:
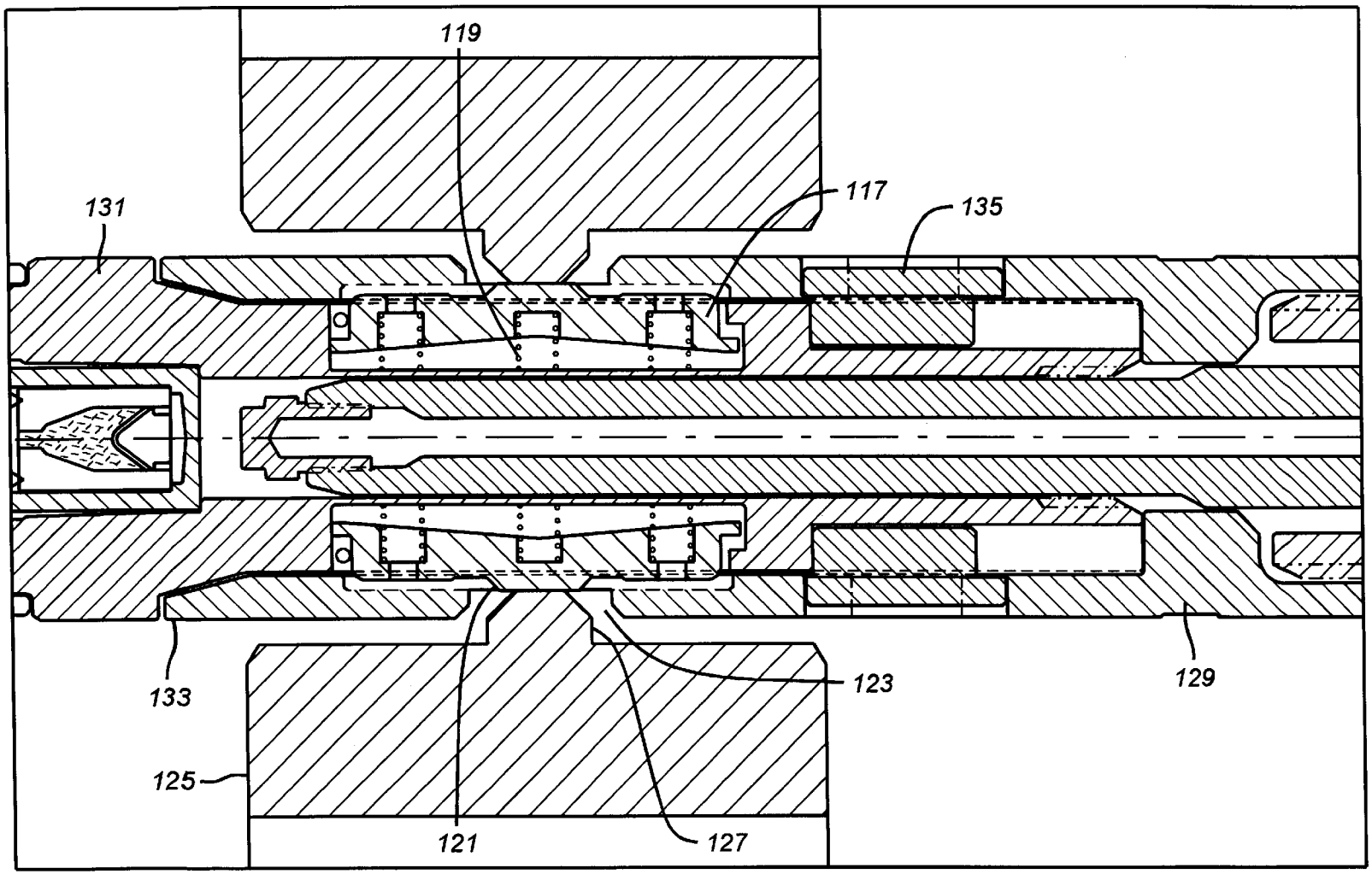
FIG. 5 is a sectional elevational view of a preferred embodiment for connecting adjacent guns, incorporating the present invention.
Figure 6:
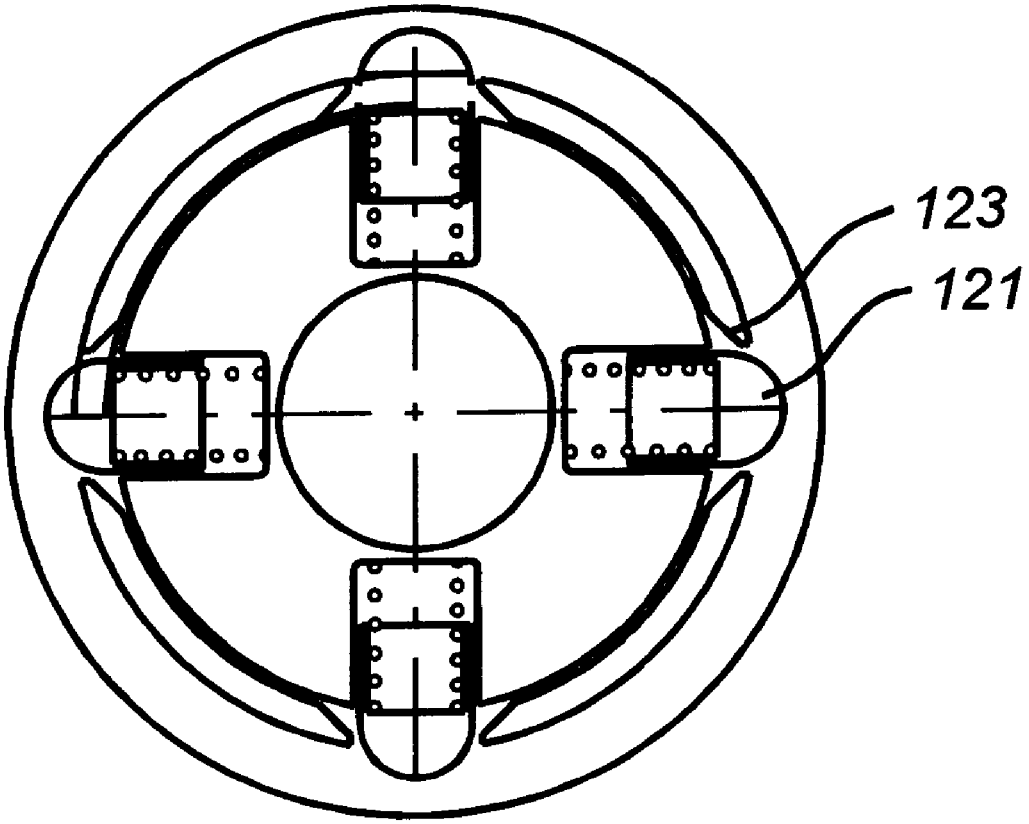
FIG. 6 is a section view through the latching dogs shown in FIG. 5.
Figure 7:
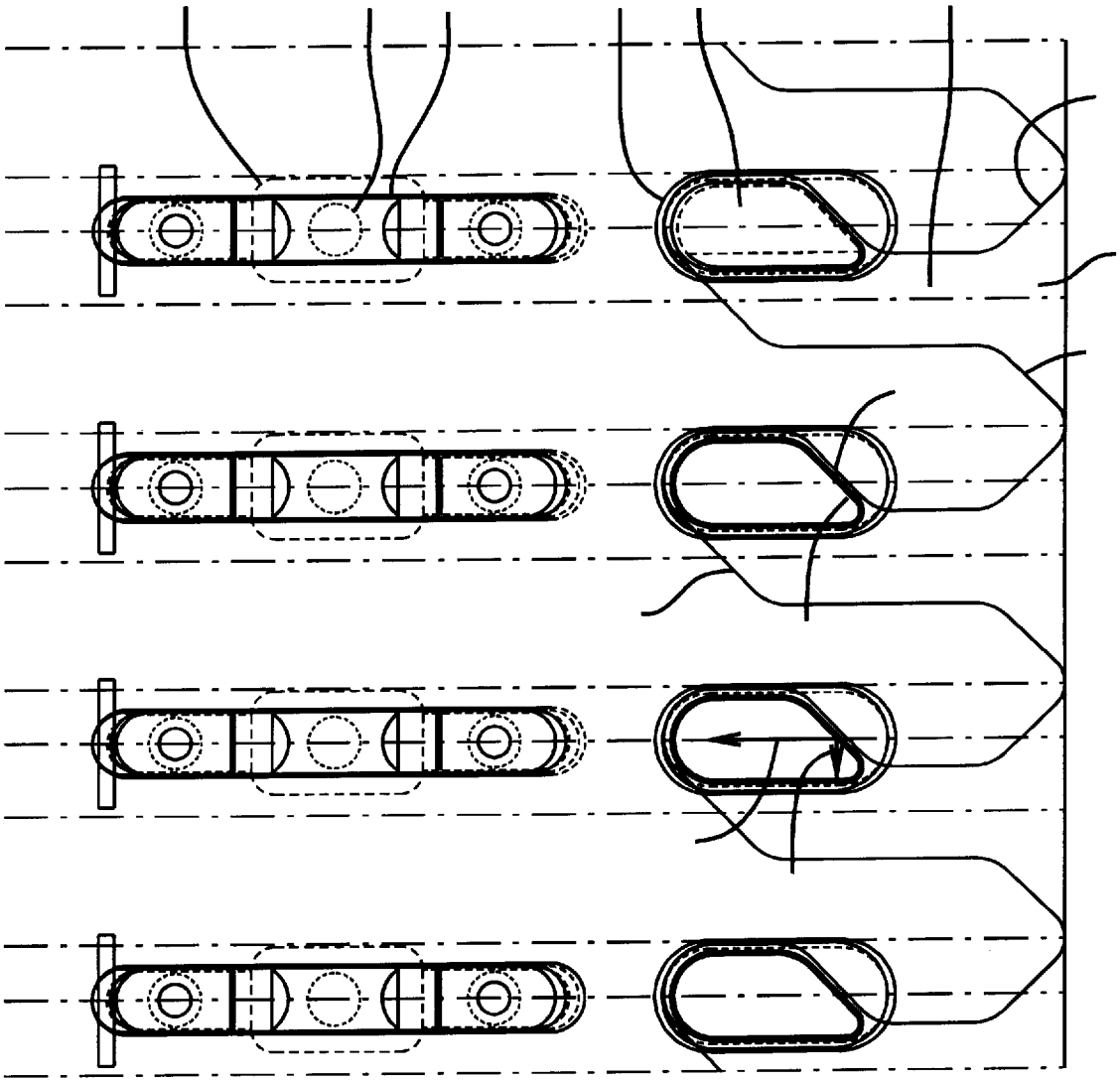
FIG. 7 is a flattened view of the lug-and-groove combination shown in FIG. 5 for transmitting longitudinal loads.

The preferred embodiment of the present invention is illustrated in FIGS. 5–7 which reflect a variation in the design of the dogs 117. The dogs 117 are still biased radially outwardly by springs 119 and comprise a projection 121 which extends into a window 123. A ram 125 has a projection 127 which can contact the projection 121 on dogs 117 to push them radially inwardly, as shown in FIG. 5, for disconnection of one gun from the next by a longitudinal force. In FIG. 5, the lower gun 129 incorporates the window 123. The upper gun 131 is inserted into the top end 133 of the lower gun 129. The lower gun 129 has a series of lugs 135. Generally speaking, there is one lug 135 to correspond to each dog 117. The juxtaposition of the lugs 135 and dogs 117, after assembly of the upper gun 131 into the lower gun 129, is best shown in FIG. 7. Those skilled in the art will appreciate that FIG. 7 shows the entire outer circumference of the upper gun 131 laid out in the two-dimensional plane. The degree references to the right indicate this feature of FIG. 7. As can be seen, the upper gun 131 has a series of slots 137, each having an inlet 139 and a closed end 141. Slots 137 have a dogleg 143 such that the centerline of end 141 is in alignment with the centerline of window 123, while the centerline of the inlet 139 is offset from the centerline of the window 123. Thus, as the upper gun 131 is advanced by lowering it into the lower gun 129, the inlets 139, which feature opposed inlet tapers 145, seek a corresponding lug 135 which is held stationary waiting for the upper gun 131 to be lowered into it. Thus, as the upper gun 131 is lowered, the openings 139 will straddle lugs 135, ultimately forcing the upper gun 131 to rotate slightly clockwise looking down from the top of the upper gun 131. This occurs because the lug 135 which is fixed is presented with the dogleg 143. The components are fabricated such that when the lugs 135 contact ends 141, the dogs 117 have rotated into complete alignment with the windows 123 so that dogs 117 can be biased outwardly by the action of springs 119. This position, with the upper gun 131 fully secured to the lower gun 129, is shown in FIG. 7. There, the lugs 135 are at ends 141 while the projections 121 on each of the dogs 117 are each in their respective windows 123. Those skilled in the art will appreciate that if for any reason the assembly of the upper gun 131 and lower gun 129 need to have a longitudinal force exerted on them to properly position them in the hole, the bulk of the longitudinal reaction force will be taken up by the interaction of bearing surface 147 which defines a part of the path of the slots 137 and loading surface 149 on the respective lug 135. These two surfaces are parallel to each other and transverse to the longitudinal axis of the assembly. They are disposed transversely to assist in easy make-up and disconnection of the guns 131 and 129. As shown in FIG. 7, arrow 151 represents the longitudinal component of the force applied to the lugs 135 when the pulling force comes from the upper gun 131 or above. Arrow 153 shows the relatively smaller radial component of the resultant force which is resisted by the fact that the dogs 117 have projections 121 extending into windows 123. Thus, while dogs 117 serve to hold together the lower gun 129 and upper gun 131, such dogs also resist the radial components 153 of the resultant force, which would otherwise separate the lower gun 129 from the upper gun 131 but for the presence of the dogs 117. If the longitudinal force is reversed, the ends 141 transfer load directly to lugs 135. Depending on the free play between dogs 117 and windows 123, the load will be passed mostly through ends 141 contacting lugs 135. Thus, end 141 and the top of lugs 135 can be the loading and bearing surfaces, respectively. It should be noted that in placement of the guns or in their removal after use, significant longitudinal forces need to be applied. Additionally, the sheer weight of the assembly also places longitudinal loads on the connection shown in FIG. 5. However, with the design shown in FIGS. 5–7, the longitudinal loads or applied longitudinal forces are principally taken up by the interaction of lugs 135 with slots 137. As opposed to the design shown in FIG. 3 where the dogs 64 withstand the dead load from the string and applied loads during operations in a longitudinal direction, the improved design shown in FIGS. 5–7 allows the bulk of the longitudinal load to be removed from the dogs 117, thus increasing the reliability of the connection under times of extremely high longitudinal loading.

It should also be noted that if the upper gun 131 is torqued in a clockwise direction looking down at the upper gun 131, the lugs 135 will also act to resist the applied torque which is transmitted by the upper gun 131 into the lower gun 129. The ability of the lugs 135 to absorb torque loads is dependent on the amount of free play between dogs 117 and windows 123. If the direction of the applied torque is reversed, i.e., counterclockwise looking down at upper gun 131, the torque will be resisted by the dogs 117 extending into windows 123. As can be seen from FIG. 7, with a torque applied in a counterclockwise direction looking down at upper gun 131, the slots 137 are twisted in such a way as to move away from lugs 135 as the dogleg 143 seeks to approach the lugs 135.

Those skilled in the art will see that the dogs 117 are reconfigured from the version shown in FIG. 3 and labeled 64 in the manner that projection 86, which appears on the dog 64 has been completely eliminated from the design of the dogs 117 shown in FIG. 5. Instead, the dogs 117 in FIG. 5 are essentially symmetrical about projection 121.

FIG. 6 illustrates in section through the dogs 117 how each of the projections 121 extends through a window 123 for securing the upper gun 131 to the lower gun 129.

Those skilled in the art will appreciate that as the upper gun 131 is advanced into the lower gun 129, the dogs 117 are necessarily offset from windows 123. When the lugs 135 encounter the doglegs 143, the upper gun 131, simply by virtue of setdown weight, is rotated as it advances downwardly to bring the dogs 117 into alignment with windows 123. In all other respects, the other details of the invention described herein are applicable to the dog design 64 as well as the preferred design shown in FIGS. 5–7 involving the slots 137 interacting with the lugs 135.

Those skilled in the art will appreciate that a known firing head is connected at the top of the string of guns and ultimately in communication with cord 93 to initiate the shaped charge 14 to fire the lower gun assembly 40. The lower gun assembly 40 can comprise a plurality of guns (see guns 40 and 41 in FIG. 4), each of which is connected by a connector C with a similar assembly as depicted, such that actuation of hammer piston 22 fires off the top-most lower gun of assembly 40, which, in turn, fires gun 41, by virtue of another shaped charge, thus allowing all the guns to be fired in sequence from the uppermost to the lowermost gun. At the top of each gun is a hammer piston assembly 22, which includes seals 24 and 26 so that after firing, despite the fact that the guns can be fired in series, the internal of each gun is sealed off to its hammer body 18 to prevent the creation of a flowpath therethrough.

Another feature that provides flexibility to the system is that if for any reason the seals 24–30 in a given hammer piston assembly 22 or hammer body 18 fail, the next gun in sequence will hopefully have functional seals comparable to seals 24–30 on its hammer piston assembly 22 and hammer body 18 such that leakage through the body of a particular gun will be a very modest amount as the seals internally in the gun below will stop any further flow from the wellbore.

Additionally, if for any reason the seal ram 53 fails to obtain an adequate seal around surface 58 of the connector C, the lubricator L is of sufficient length so that the next lower seal ram 52 can do the same job. Other rams in the lubricator L can be operated prior to relying on a last resort, which is using the shear ram 62.

The advantages of the present invention should now be apparent. The connector C facilitates engagement between guns using set down weight only. Disengagement is accomplished using actuating ram 88 to push dogs 64 out of engagement with the connector C. Another advantage is that internally the guns that are connected in this manner can be fired in sequence and after firing there is no internal fluid passage for the fluids in a well under pressure to flow through as the guns are being removed. Through the use of sealed hammer pistons 22, the sequential firing of guns can be accomplished while the communication between guns through the connector C is eliminated. However, even in the event of failure of internal seals, such as 24 and 26, on a hammer piston 22, only a limited volume must be purged through the lubricator L if the comparable seals around a hammer piston 22 that is further down in the hole are holding. In the event of a failure to obtain an external seal around a given gun using the seal ram 53, the length of the lubricator is such that the next seal ram 52 in sequence can be actuated to deter mine if an external seal can be obtained in that manner on the next gun down. If that is not workable and all other available seal rams don't hold well pressure, then use is made of shear ram 62. At this time, with the guns in position as shown in FIG. 4, the shear ram 62 is already in position opposite the emergency shear zone indicated by arrow 34 so that the shear ram 62 can be actuated to shut in the well completely. It will not cut through a zone that houses any explosives. This occurs because with a given gun supported by the seal ram 52, the orientation of the connector C is such that a portion of the housing hammer piston 22 is oriented adjacent the shear ram 62. Thus, the present invention, by providing the internal sealing capability for the guns in the string, facilitates the safe removal of the guns through a lubricator in a live well situation. The ease of connecting and disconnecting simply by pull or push forces without rotation further provides a more secure make-up and allows for faster rig up with more economical lubricators which are simpler since the lubricators envisioned in the present invention do not need a feature to initiate rotation.

Those skilled in the art will appreciate that the latching procedure can be accomplished with the actuating ram 88 in the extended position where projection 90 extends into window 78.

Those skilled in the art will appreciate that when the shaped charge 14 is set off, it penetrates though walls 94 and 96 to open up communication to passage 20. Accordingly, in the fired position, walls 94 and 96 will have been blown out of the way to allow pressure communication to the hammer piston 22 to set off the initiator 36 and fire the next gun below. Seals 24, 26, 28, and 30 retain the pressure to allow hammer piston 22 to move. Accordingly, a system of connector C is illustrated with internal sealing mechanisms around the hammer piston 22, which allows a series of guns to be fired with the internal passageways therethrough being retained in a sealing condition. Removal is thus made far safer in a live well situation.

FIG. 4 illustrates how the string of guns can be inserted and removed from the wellbore. A key to the insertion or removal of the guns is a running tool 101 which is configured to have a series of dogs, such as 64, so that it can slip in and be attached to any given gun that has a connector C. Illustrated in FIG. 4 are four guns 10, 40, 41, and a part of gun 103. Initially, the lubricator L is isolated from the weilbore. Assuming for the sake of illustration that gun 103 is the first to be inserted in the string with the running tool 101, the procedure follows the following detailed steps. The running tool 101 is latched into the connector C, which is mounted to the top of gun 103. Gun 103 advances until an upset 105 hits a no-go shoulder 107. The drawing reflects the two positions of the upset 105 with the upper position illustrated by the reference numeral 105 and the lower position by the reference numeral 105'. When the running tool 101 advances gun 103 to the point where upset 105' is bottomed on the no-go shoulder 107, the recess surface 109 is in position opposite seal ram 53. At the same time, the dogs 64 in the running tool 101 are oriented such that they are in line through the window 78 for release by the actuating ram 88. Accordingly, the first gun 103 is run in with the running tool 101 until the running tool 101 bottoms on no-go shoulder 107, at which point the seal ram 53 holds gun 103 while operation of actuating ram 88 allows the running tool 101 to disengage from gun 103 for removal from the lubricator. At this time, the next gun 41 is picked up outside the lubricator by the running tool 101 by the same latching technique previously described and illustrated in FIG. 3. At this point in time, the lower end of gun 41 also has a connector C, which has its own set of latching dogs. The portions of the connector are made up by set down weight on the running tool 101 which allows the dogs 64 of gun 41 to latch into the mating portion of the connector C, which is already secured to gun 103. The surface personnel then pick-up on running tool 101 to see if resistance is encountered. If resistance is encountered, it is a signal that the latching of gun 41 into gun 103 has occurred. It should be noted that the testing of the latched connection between guns 41 and 103 occurs while 103 is supported by the seal ram 53. Thereafter, pressure is equalized on both sides of seal ram 53 by bringing the pressure above it to the wellbore pressure which is below it. The pressure above the seal ram 53 is retained by the stripper rams 111 and 113, which are closed over the running tool 101. With the seal ram 53 released after equalization, the running tool is forced through the stripper rams 111 and 113 until the upset 105 reaches the position indicated by 105' at which time the seal ram 53 is actuated on gun 41. Additionally, seal ram 52 can be actuated on gun 103.

The process is then repeated to add gun 40 and ultimately gun 10. Depending on the length of the guns and the height of the derrick, the guns can be installed or removed individually, or more than one at a time. However, in order to remove more than one gun at a time, the actuating ram assembly 88 will also need to be disposed adjacent seal ram 52 to facilitate disconnection at a point where more than one gun can be removed, for example.

The removal process is the reverse of the insertion process, except that the upset 105 lands on stripper ram 113 to indicate proper juxtaposition of a set of dogs 64 opposite the actuating ram 88. Thus, In the configuration actually shown in FIG. 4, the seal ram 53 would be closed around the recess 43 and the annular space around gun 10 would be vented. With the sealing integrity of ram 53 determined, ram 88 is actuated to release gun 10 from gun 40. With the stripper rams 111 and 113 now in the open position, the upset 105 can clear past them to take out gun 10. While this process is going on for a back-up seal, ram 52 is maintained in the closed position. It should be noted that the no-go shoulder 107 can be made of a separate piece which is releasably secured within the lubricator such that if an emergency situation arises and all the guns need to be brought down below to shear ram 62 in a hurry, the no-go shoulder 107 will not prevent the entire assembly, along with the running tool 101 from being advanced downhole quickly below shear ram 62 for an emergency shutdown.

If for any reason any of the set of dogs 64 fail to release when the actuating ram 88 is operating, the running tool 101 can be rotated to undo thread 115 so that the running tool can be released from the particular gun in question and then a fishing tool may be sequentially inserted to grab a hold of the connector C to pull out the gun which fails to release by release of the dogs 64.

It should be noted that the seal rams 52 and 53 can fully support the weight of the entire string and that these two rams back each other up.

Accordingly, with the layout shown in FIG. 4*a*–4*c* and the process as described, the guns can be run into a live well in a string and can be removed from a live well by reversing the illustrated procedure.

The advantages of the invention are most needed when the gun string exceeds the length of the lubricator. Guns are normally about 14 feet long and derrick height limitations may require piecemeal assembly of guns, even if the overall gun string is shorter than the lubricator. The invention can facilitate assembly of the gun string even if its total length is shorter than the lubricator since in that event, the ram is not operated until the entire gun string is fully assembled. Even in that case, the dog method of attachment speeds assembly.

The foregoing disclosure and description of the invention are illustrative and explanatory thereof, and various changes in the size, shape and materials, as well as in the details of the illustrated construction, may be made without departing from the spirit of the invention.

What is claimed is:

1. A connection to attach a first downhole tool to a second downhole tool, both tools having a longitudinal axis, comprising:

a guide on one of said first downhole tool and said second downhole tools to guide movement of said first downhole tool with respect to said second downhole tool;

a latch mechanism having at least a portion thereof on each of said first and second downhole tools to selectively hold them together;

said lug and guide interacting in a load bearing relationship to minimize the effect of longitudinal force on said latch mechanism when said latch mechanism is set resulting from applied load to at least one of said downhole tools.

2. The connection of claim 1, wherein:

said lug and guide combine to assist said latch mechanism to set.

3. The connection of claim 2, wherein:

said latch mechanism achieves its set position by virtue of setting down one of said downhole tools on another.

4. The connection of claim 3, wherein:

said lug and guide combine to create a relatives rotation between said first and second downhole tools as a result of relative longitudinal movement between said lug and said guide.

5. The connection of claim 1, wherein:

said guide comprises a dogleg which has the effect of turning one of said downhole tools as it is set down on another downhole tool which is being held stationary.

6. The connection of claim 5, wherein:

said latch mechanism comprises at least one dog on one of said downhole tools and at least one window in the other of said downhole tools;

said lug following said guide to rotate said dog into alignment with said window as a result of setting down one of said downhole tools on the other.

7. The connection of claim 5, wherein:

one of said guide and said lug defining a bearing surface;

the other of said guide and said lug comprising a loading surface such that when said loading surface contacts said bearing surface, longitudinal loads are principally passed through said engaged surfaces rather than said latch mechanism.

8. The connection of claim 7, wherein:

said bearing and loading surfaces are flat and disposed transversely to said longitudinal axes of said downhole tools.

9. The connection of claim 6, wherein:

said downhole tools releasable from each other when said dog is forced into said window and a longitudinal force moves said lug and guide apart.

10. A connection to attach a first downhole tool to a second downhole tool, both tools having a longitudinal axis, comprising:

a guide on one of said first downhole tool and said second downhole tools to guide movement of said first downhole tool with respect to said second downhole tool;

a latch mechanism having at least a portion thereof on each of said first and second downhole tools to selectively hold them together;

said lug and guide interacting to minimize the effect of longitudinal force on said latch mechanism when said latch mechanism is set;

a lubricator mounted to a well;

said downhole tools movable through said lubricator into a live well;

said latch mechanism sets in said lubricator without applied rotation to the downhole tool being moved into contact with another stationary downhole tool supported in said lubricator.

11. A connection to attach a first downhole tool to a second downhole tool, both tools having a longitudinal axis, comprising:

guide on one of said first downhole tool and said second downhole tools to guide movement of said first downhole tool with respect to said second downhole tool;

a latch mechanism having at least a portion thereof on each of said first and second downhole tools to selectively hold them together:

said lug and guide interacting to minimize the effect of longitudinal force on said latch mechanism when said latch mechanism is set;

said guide comprises a dogleg which has the effect of turning one of said downhole tools as it is set down on another downhole tool which is being held stationary;

one of said guide and said lug defining a bearing surface;

the other of said guide and said lug comprising a loading surface such that when said loading surface contacts said bearing surface, longitudinal loads are principally passed through said engaged surfaces rather than said latch mechanism;

said bearing and loading surfaces are flat and disposed transversely to said longitudinal axes of said downhole tools;

said downhole tools releasable from each other when said dog is forced into said window and a longitudinal force moves said lug and guide apart; and said transverse orientation of said loading and bearing surfaces promotes their disengagement responsive to an applied longitudinal force with said dog pushed into said window.

12. An assembly for connecting downhole tools and running them into and out of a live well, comprising:

a lubricator mounted to a well;

at least a first downhole tool and a second downhole tool;

at least one connector comprising a first and second body members with said first body member mounted to said first downhole tool and said second body member mounted to said second downhole tool;

a guide on one of said first body member and said second body member engageable with a lug on the other one of said first and second body members to guide movement of said first body member with respect to said second body member;

a latch mechanism having at least a portion thereof on each of said first and second body members to hold them together;

said lug and guide interacting to minimize the effect of longitudinal force on said latch mechanism when said latch mechanism is set.

13. The assembly of claim 12, wherein:

said latch mechanism achieves its set position by virtue of setting down one of said body members on another.

14. The assembly of claim 13, wherein;

said guide comprises a dogleg which has the effect of turning one of said body members as it is set down on another body member which is being held stationary.

15. The assembly of claim 14, wherein:

said latch mechanism comprises at least one dog on one of said body members and at least one window in the other of said body members;

said lug following said guide to rotate said dog into alignment with said window as a result of setting down one of said body members on the other.

16. The assembly of claim 14, wherein:

one of said guide and said lug defining a bearing surface;

the other of said guide and said lug comprising a loading surface such that when said loading surface contacts said bearing surface, longitudinal loads are principally passed through said engaged surfaces rather than said latch mechanism.

17. The assembly of claim 16, wherein:

said bearing and loading surfaces are flat and disposed transversely to said longitudinal axes of said body members.

18. The assembly of claim 12, wherein:

said latch mechanism sets without applied rotation to the body member being moved into contact with another stationary body member.

19. The assembly of claim 15, wherein:

said body members releasable from each other when said dog is forced into said window and a longitudinal force moves said lug and guide apart.

20. The assembly of claim 12, wherein:

said downhole tools comprise perforating guns.

21. An assembly for connecting downhole tools and running them into and out of a live well, comprising:

a lubricator mounted to a well;

at least a first downhole tool and a second downhole tool;

at least one connector comprising a first and second body members with said first body member mounted to said first downhole tool and said second body member mounted to said second downhole tool;

a guide on one of said first body member and said second body member engageable with a lug on the other side of said first and second body members to guide movement of said first body member with respect to said second body member:

a latch mechanism having at least a portion thereof on each of said first and second body members to hold them together;

said lug and guide interacting to minimize the effect of longitudinal force on said latch mechanism when said latch mechanism is set;

said latch mechanism achieves its set position by virtue of setting down one of said body members on another;

said guide comprises a dogleg which has the effect of turning one of said body members as it is set down on another body member which is being held stationary;

one of said guide and said lug defining a bearing surface;

the other of said guide and said lug comprising a loading surface such that when said loading surface contacts said bearing surface, longitudinal loads are principally passed through said engaged surfaces rather than said latch mechanism;

said bearing and loading surfaces are flat and disposed transversely to said longitudinal axes of said body members;

said body members releasable from each other when said dog is forced into said window and a longitudinal force moves said lug and guide apart; and said transverse orientation of said loading and bearing surfaces promotes their disengagement responsive to an applied longitudinal force with said dog pushed into said window.

* * * * *